US006274826B1

(12) United States Patent
Serizawa et al.

(10) Patent No.: US 6,274,826 B1
(45) Date of Patent: Aug. 14, 2001

(54) SWITCH UNIT

(75) Inventors: Yasuyoshi Serizawa; Minoru Kubota; Keizo Nishitani, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 19 days.

(21) Appl. No.: 09/685,797

(22) Filed: Oct. 11, 2000

(30) Foreign Application Priority Data

Oct. 15, 1999 (JP) ..... 11-293692

(51) Int. Cl.[7] ..... H01H 9/00

(52) U.S. Cl. ..... 200/5 R; 200/1 B; 200/6 R; 200/5.7; 200/339

(58) Field of Search ..... 200/1 R, 1 B, 200/4, 5 R, 17 R, 18, 6 R, 6 A, 512, 5.7, 329, 339

(56) References Cited

U.S. PATENT DOCUMENTS 5,115,108 * 5/1992 Ogawa et al. ..... 200/1 B
5,559,311 * 9/1996 Gorbatoff ..... 200/513
5,693,920 * 12/1997 Maeda ..... 200/1 B
5,719,361 * 2/1998 Lee ..... 200/1 B
5,783,787 * 7/1998 Data ..... 200/5 R

* cited by examiner

*Primary Examiner*—Michael Friedhofer
(74) *Attorney, Agent, or Firm*—Armstrong, Westerman, Hattori, McLeland & Naughton, LLP

(57) ABSTRACT

A switch unit is provided, which includes: an operative body being swingingly operably provided; a pair of first switch portions being abuttable on respective end portions of the operative body when the operative body is swingingly operated so as to output signals to raise and lower, respectively, a window glass; a pair of second switch portions arranged apart from a line connecting the pair of first switch portions and nearer a longitudinal middle portion of the operative body than the first switch portions and being abuttable on the operative body when the operative body is swingingly operated so as to output signals to raise and lower, respectively, the window glass; and a pair of supporting portions arranged opposite to the pair of second switch portions with respect to the line, wherein the supporting portions abut on respective portions of the operative body when the first switch portions abut on the respective end portions of the operative body.

12 Claims, 6 Drawing Sheets

SWITCH UNIT

BACKGROUND OF THE INVENTION

1. Field of the Invention

The present invention relates to a switch unit to be used for operating various devices such a powerwindow unit mounted on a vehicle such as a motor vehicle.

2. Description of the Related Art

A powerwindow unit up/down-operates a window glass installed at a door trim of a vehicle. Based on an operation signal from a switch unit provided on the door trim, the powerwindow unit drives a motor and so on for up/down-operating the window glass, thereby opening and closing a window.

The above switch unit has a knob as a operative body which is swingingly operably provided, a printed circuit board, and a decorative members to outline the printed circuit board and to make the knob exposed. A pair of first switch portions being abuttable on respective end portions of the knob are provided on the printed circuit board. Each first switch portion has both of a first contact portion provided on the printed circuit board and a first contacting member being contactable and discontactable with the first contact portion.

Between one first contacting member and one end portion of the knob provided are a returning spring and a pressing pin, which pressing pin presses one first contacting member toward the printed circuit board when one end portion of the knob is pushed toward the printed circuit board. Also, between the other first contacting member and the other end portion of the knob provided are a returning spring and a pressing pin, which pressing pin presses the other first contacting member toward the printed circuit board when the other end portion of the knob is pushed toward the printed circuit board. On the other hand, each returning spring returns the knob in an initial state.

According to the above-described structure of the conventional switch unit, when one end portion of the knob is pushed toward the printed circuit board, one first contacting member is pressed through the pressing pin and comes into contact with one first contact portion. Then, one first contact portion outputs a signal, for example, to raise the window glass toward the powerwindow unit.

On the other hand, when the other end portion of the knob is pushed toward the printed circuit board, the other first contacting member is pressed through the pressing pin and comes into contact with the other first contact portion. Then, the other first contact portion outputs a signal, for example, to lower the window glass toward the powerwindow unit.

And, when the pushing operation of one end portion or the other end portion of the knob is removed, one end portion or the other end portion of the knob returns to each initial state by means of each returning spring, whereby the output signal from each contact portion stops.

With respect to the above conventional switch unit, rolling of the knob would arise during the pushing operation, which would cause an un-smooth up/down operation of the window glass.

Otherwise, a switch unit having a pair of second switch portions, which are arranged apart from a line connecting the first switch portions and nearer a swing center of the knob than the first switch portions, has been used. In this switch unit, the second switch portions are also provided on a printed circuit board. Each second switch portion has both of a second contact portion provided on the printed circuit board and a second contacting member being contactable and discontactable with the second contact portion.

In this switch unit having the first switch portions and the second switch portions, when one or the other second contacting member is put into contact with one or the other second contact point, respectively, while one or the other first contacting member is put into contact with one or the other first contact point, respectively, the window glass goes up or down to top or bottom dead point, respectively.

With respect to this conventional switch unit, rolling of the knob would still arise during the pushing operation, which would also cause an un-smooth up/down operation of the window glass.

SUMMARY OF THE INVENTION

In view of the foregoing, an object of the present invention is to provide a switch unit enabling a window glass to go up and down smoothly.

In order to achieve the above-described object, as a first aspect of the present invention, a switch unit comprises: an operative body being swingingly operably provided; a pair of first switch portions being abuttable on respective end portions of the operative body when the operative body is swingingly operated so as to output signals to raise and lower, respectively, a window glass; a pair of second switch portions arranged apart from a line connecting the pair of first switch portions and nearer a longitudinal middle portion of the operative body than the first switch portions and being abuttable on the operative body when the operative body is swingingly operated so as to output signals to raise and lower, respectively, the window glass; and a pair of supporting portions arranged opposite to the pair of second switch portions with respect to the line, wherein the supporting portions abut on respective portions of the operative body when the first switch portions abut on the respective end portions of the operative body.

According to the above-described structure, since the operative body is supported by the second switch portion and the supporting portion when the first switch portion outputs a signal to up/down-operate the window glass, rolling of the operative body can be prevented, while attaining a clicking-feel of the switch. Therefore, the switch unit enables the window glass to smoothly go up and down.

As a second aspect of the present invention, in the structure with the above second aspect, the supporting portions are formed in a same shape as at least either of the first and second switch portions.

According to the above-described structure, since the supporting portions are formed in the same shape as at least either of the first and second switch portions, the supporting portions can be formed easily, thereby reducing trouble for manufacturing the switch unit and therefore reducing the costs. Further, in case that the supporting portions are formed in the same shape as the second switch portion, the supporting portions can support the operative body more securely, whereby rolling of the operative body can be prevented, thereby ensuring the window glass to smoothly go up and down.

As a third aspect of the present invention, in the structure with the above second aspect, the switch unit further comprises a base equipped with the pair of first switch portions, the pair of second switch portions, and the pair of supporting portions, the base including a plate member having: a pair of projections projecting toward the operative body and forming outlines of the respective first switch portions; a pair of second projections being in a same shape as the projections, projecting toward the operative body, and forming outlines of the respective second switch portions; and a pair of supporting projections being in a same shape as the projections, projecting toward the operative body, and forming outlines of the respective supporting portions.

According to the above-described structure, since all the projections are formed in the same shape and are formed integrally with the plate member of the base, the first switch portions, the second switch portions, and the supporting portions can be formed easily, thereby reducing trouble for manufacturing the switch unit and therefore reducing the costs.

As a forth aspect of the present invention, in the structure with any one of the above aspects, the pair of supporting portions are arranged symmetrically with the second switch portions with respect to the line.

According to the above-described structure, owing to the symmetrical arrangement, the supporting portions can support the operative body still more securely, whereby rolling of the operative body can be prevented, thereby ensuring the window glass to smoothly go up and down.

As a fifth aspect of the present invention, a switch unit comprises: an operative body being swingingly operably provided; a pair of first switch portions being abuttable on respective end portions of the operative body when the operative body is swingingly operated so as to output signals to raise and lower, respectively, a window glass; and a plurality of supporting portions arranged on both sides of a line connecting the pair of first switch portions and nearer a longitudinal middle portion of the operative body than the first switch portions while putting the first switch portions therebetween, wherein the supporting portions abut on respective portions of the operative body when the first switch portions abut on the respective end portions of the operative body.

According to the above-described structure, since the operative body is supported by a plurality of supporting portions when the first switch portion outputs a signal to up/down-operate the window glass, rolling of the operative body can be prevented, while attaining a clicking-feel of the switch. Therefore, the switch unit enables the window glass to smoothly go up and down.

As a six aspect of the present invention, in the structure with the above fifth aspect, the plurality of supporting portions are formed in a same shape as the first switch portions.

According to the above-described structure, since the plurality of supporting portions are formed in the same shape as the first switch portions, the supporting portions can be formed easily, thereby reducing trouble for manufacturing the switch unit and therefore reducing the costs.

As a seventh aspect of the present invention, in the structure with the above sixth aspect, the switch unit further comprises a base equipped with the pair of first switch portions and the plurality of supporting portions, the base including a plate member having: a pair of projections projecting toward the operative body and forming outlines of the respective first switch portions; and a plurality of supporting projections being in a same shape as the projections, projecting toward the operative body, and forming outlines of the respective supporting portions.

According to the above-described structure, since the projections of the first switch portions and of the supporting portions are formed in the same shape and are formed integrally with the plate member of the base, the first switch portions and the supporting portions can be formed easily, thereby reducing trouble for manufacturing the switch unit and therefore reducing the costs.

As an eighth aspect of the present invention, in the structure with any one of the above fifth to seventh aspects, the plurality of supporting portions are arranged symmetrically with respect to the line.

According to the above-described structure, owing to the symmetrical arrangement, the supporting portions can support the operative body still more securely, whereby rolling of the operative body can be prevented, thereby ensuring the window glass to smoothly go up and down.

The above and other objects and features of the present invention will become more apparent from the following description taken in conjunction with the accompanying drawings.

DESCRIPTION OF THE PREFERRED EMBODIMENT(S)

An embodiment of the present invention will now be described in further detail with reference to FIGS. 1–7.

Figure 1:
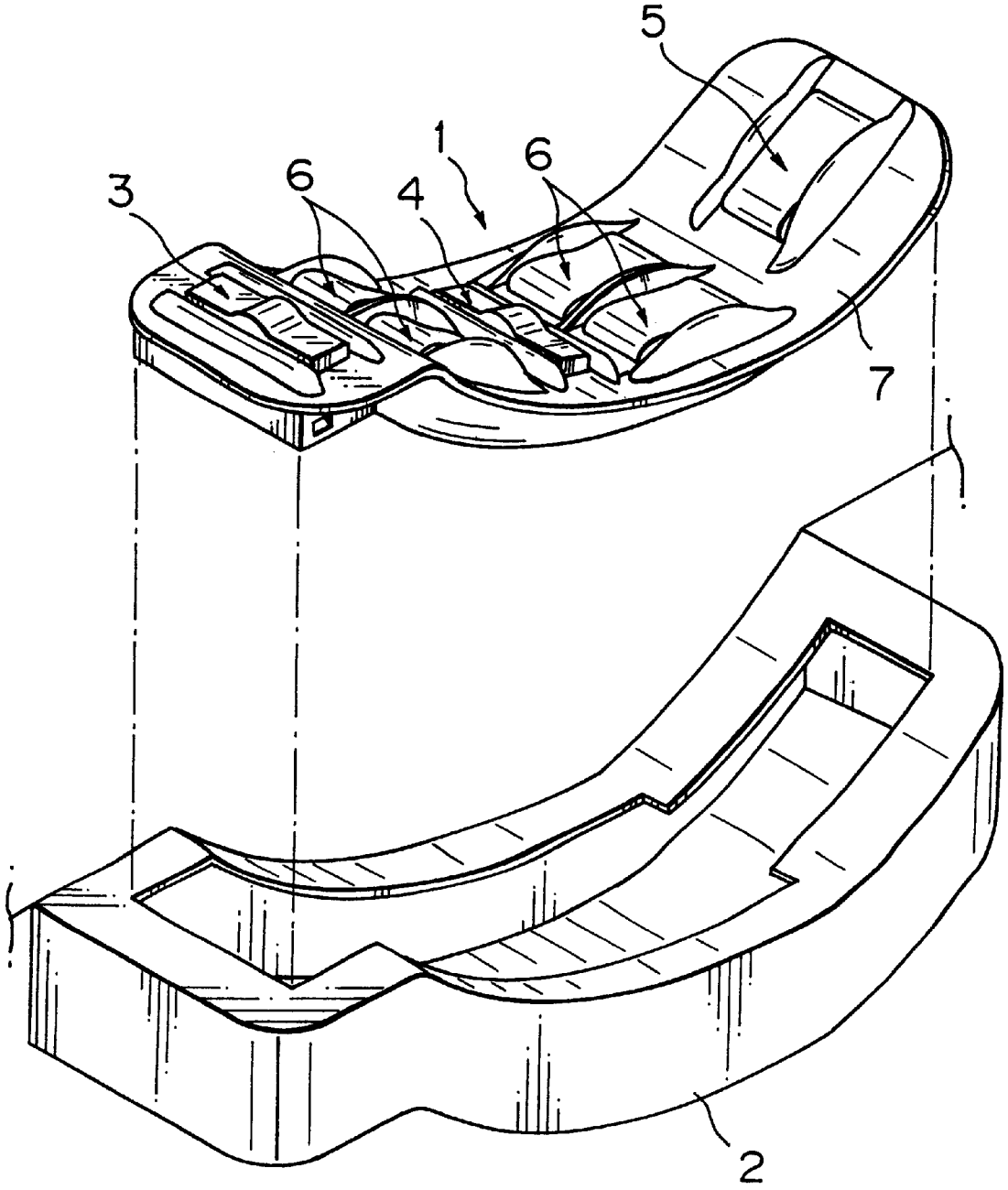
FIG. 1 is a perspective view showing an embodiment of a switch unit in accordance with the present invention.

A switch unit 1 as an embodiment of the present invention is mounted onto an arm rest 2 provided on a driver's seat-side door trim of a vehicle, as shown in FIG. 1.

The switch unit 1 operates a powerwindow unit equipped on a vehicle. The powerwindow unit makes a window glass attached to the door trim go up and down. The switch unit 1 shown in FIG. 1 conducts a going up and down operation of all the window glasses of a vehicle.

Figure 2:
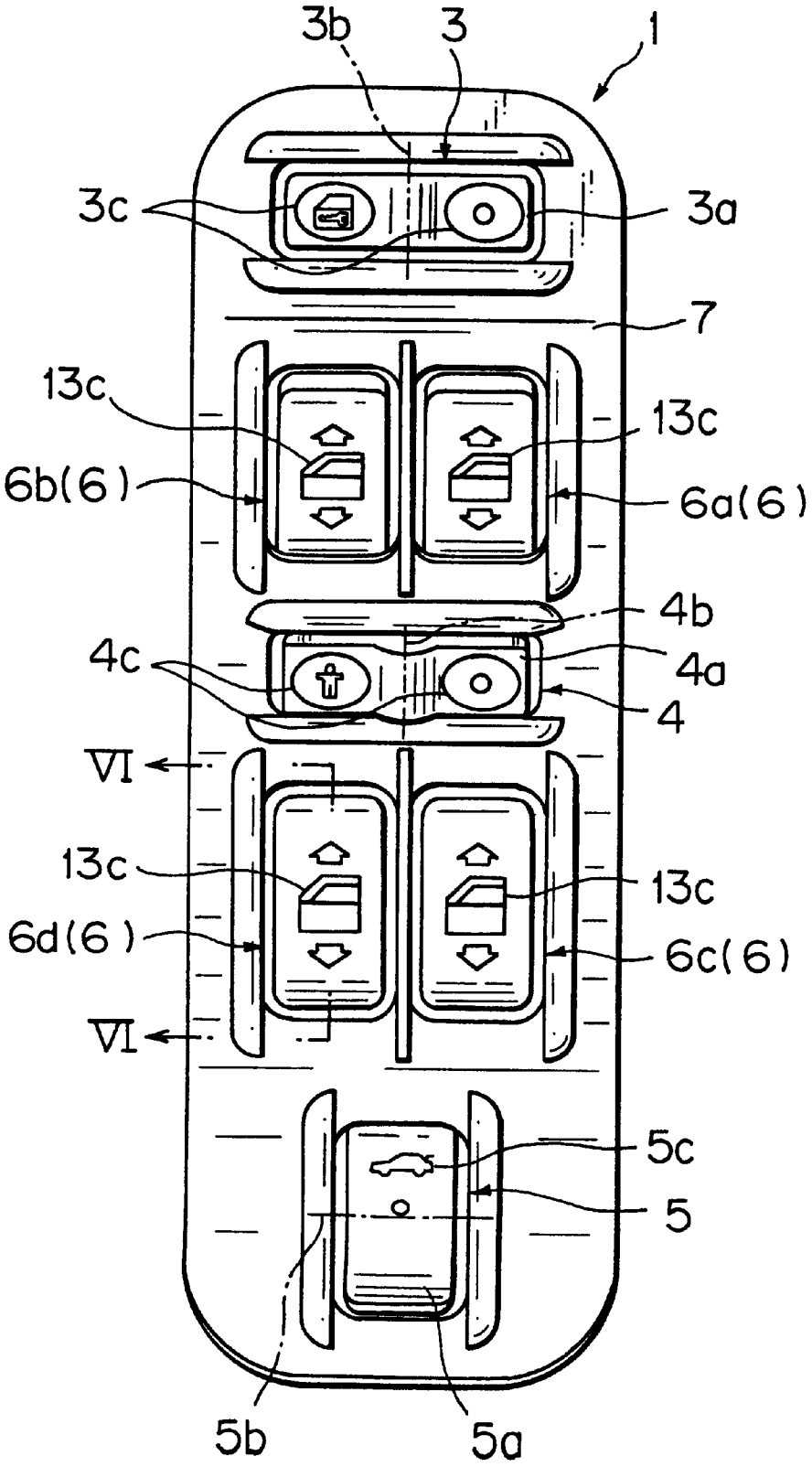
FIG. 2 is a plan view showing the switch unit of FIG. 1.

The switch unit 1, as shown in FIGS. 1 and 2, is equipped with a door locking switch 3, a window locking switch 4, a trunk opening switch 5, a plurality of window switches 6, and a decorative member 7 which exposes these switches 3,4,5,6 for a driver, outlines various devices provided inside the switch unit 1, and prevents garbage from invading inside the switch unit 1.

The door locking switch 3 is arranged at the front among the switches 3,4,5,6 in the present embodiment. The door locking switch 3 is formed in a laterally strip-like shape and has a door locking knob 3*a* exposed from the decorative member 7. The door locking knob 3*a* is swingably provided about a supporting axis 3*b* sitting approximately along a longitudinal axis of the switch unit 1.

In the door locking switch 3, for example, when one end portion of the right-side end of the door locking knob 3*a* (FIG. 2) is pushed (or pressed) while swinging about the supporting axis 3*b*, a door locking signal to lock all the doors of the vehicle is output from the door locking switch 3 to a non-shown ECU (Electronic Control Unit) which is mounted inside the door panel so as to lock and unlock the doors.

And, when the other end portion portion, i.e. left side, of the door locking knob 3*a* is pushed while swinging about the supporting axis 3*b,* a door unlocking signal to release the locking of all the doors is output from the door locking switch 3 to the ECU.

The trunk opening switch 5 is arranged at the rear among the switches 3,4,5,6. The trunk opening switch 5 is formed in a longitudinally strip-like shape and has a trunk opening knob 5*a* exposed from the decorative member 7. The trunk opening knob 5*a* is swingably provided about a supporting axis 5*b* sitting approximately along a longitudinal axis of the switch unit 1.

In the trunk opening switch 5, for example, when one end portion, i.e. the front end, of the trunk opening knob 5*a* (FIG. 2) is pushed (or pressed) while swinging about the supporting axis 5*b,* a trunk opening signal to open a trunk of the vehicle is output from the trunk opening switch 5 to a non-shown ECU which conducts opening of the trunk.

The window locking switch 4 is arranged between the door locking switch 3 and the trunk opening switch 5. The window locking switch 4 is formed in a laterally strip-like shape and has a window locking knob 4*a* exposed from the decorative member 7. The window locking knob 4*a* is swingably provided about a supporting axis 4*b* sitting approximately along a longitudinal axis of the switch unit 1.

In the window locking switch 4, for example, when one end portion of the right-side end of the window locking knob 4*a* (FIG. 2) is pushed (or pressed) while swinging about the supporting axis 4*b,* a window locking signal to lock all the window glasses in a closed state is output from the window locking switch 4 to a non-shown ECU which conducts locking and unlocking of the window glasses.

And, when the other end portion portion, i.e. left side, of the window locking switch 4 is pushed while swinging about the supporting axis 4*b,* a window unlocking signal to release the locking of all the window glasses is output from the window locking switch 4 to the ECU.

The above knobs 3*a,*4*a,*5*a* are provided with respective patterns 3*c,*4*c,*5*c* to indicate an operation state of each of the switches 3,4,5 to a driver.

A plurality of window switches 6 are provided correspondingly to the respective window glasses. As shown, a first window switch 6*a* to up/down-operate the window glass near the driver's seat, a second window switch 6*b* to up/down-operate a window glass near an assistant's seat, a third the window switch 6*c* to up/down-operate a window glass near a rear-right seat, and a fourth window switch 6*d* to up/down-operate a window glass near a rear-left seat are provided.

And, the above first and second window switches 6*a,*6*b,* are arranged laterally, i.e. in a vehicle's width direction, in parallel each other and are arranged between the door locking switch 3 and the window locking switch 4.

The above third and fourth the window switches 6*c,*6*d,* are also arranged laterally in parallel each other and are arranged between the window locking switch 4 and the trunk opening switch 5.

Hereinafter, since the window switches 6*a,*6*b,*6*c,*6*d* are similar to each other, their structures and the like will be described by using the fourth window switch 6*d* (hereinafter, merely described as "window switch 6").

Figure 3:
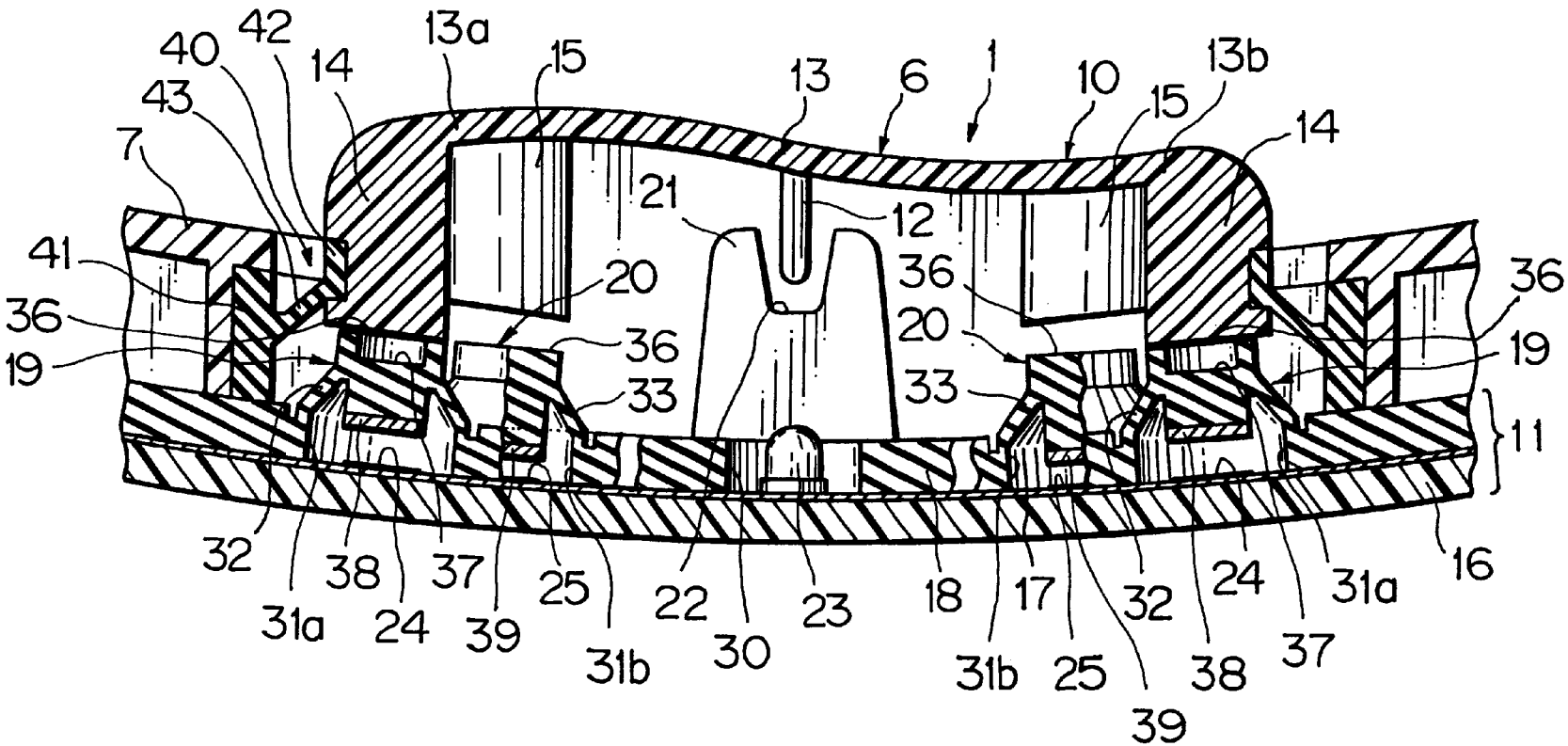
FIG. 3 is a sectional view of a window switch, taken along a line VI—VI in FIG. 2.

The window switch 6 has a the knob 10 as an operative body, a base 11 and an elastic support member 40, as shown in FIG. 3. The knob 10 has an operating tabular portion 13, which is formed strip-like in a longitudinal direction of a vehicle and operated with a fingertip of a driver, and a pair of first leg portions 14 which extend from one end portion 13*a* (i.e. front side) and the other end portion 13*b,* respectively, to the base 11.

The operating tabular portion 13 of the knob 10 is exposed over the decorative member 7 toward a driver. The operating tabular portion 13 of the knob 10 is provided with a pattern 13*c* on the surface thereof to indicate an operation state of the switch 6 to a driver.

The pattern 13*c* is, for example, transparent, and the other part thereof is opaque black for example. The end portions 13*a,*13*b* of the operating tabular portion 13 are of end portions of the knob 10.

And, a fulcrum piece 12 and second leg portions 15 are integrally formed on the knob 10. The fulcrum piece 12 projects from the inside of the operating tabular portion 13 at a longitudinal middle portion thereof toward the base 11, namely in an on/off direction of later-described first and second contact portions 24,25 with respect to the knob 10. The fulcrum piece 12 is arranged along a width direction of the knob 10.

The second leg portion 15 is provided on each of the end portions 13*a,*13*b* of the operating tabular portion 13. The second leg portions 15 are arranged inside the respective first leg portions 14, namely nearer the fulcrum piece 12. The second leg portions 15 extend from the operating tabular portion 13 toward the base 11.

Figure 4:
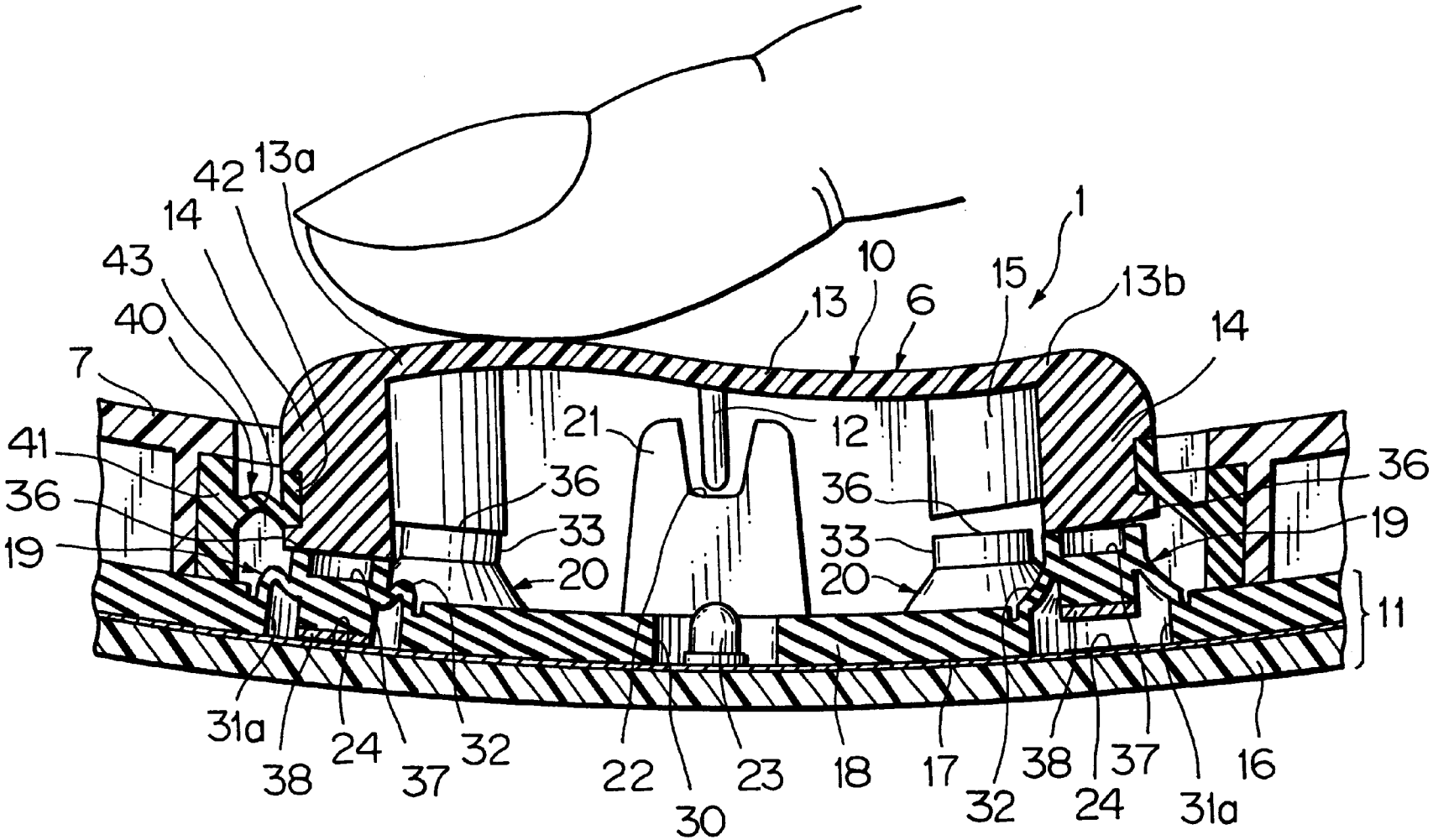
FIG. 4 is also a sectional view of the window switch of FIG. 3, wherein one end portion of a knob has been pushed.

As shown in FIG. 4, when the first switch portions 19 are pushed toward the base 11 by the first leg portions 14 as described later and then the contact portions 24 (later-described) are put into contact with the respective contacting members 38, the second leg portions 15 abut on respective end faces 36 of second projections 33 of second switch portions 20. At this time, a contact portion and a contacting member of each of the second switch portions 20 are kept apart from each other.

Figure 7:
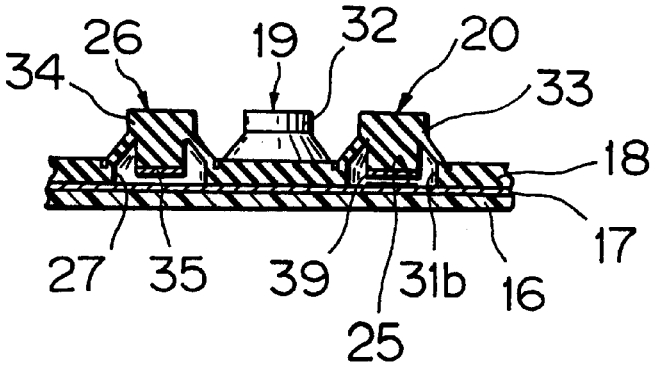
FIG. 7 is a sectional view of the window switch, taken along a line VII—VII in FIG. 6.

The base 11 has a base member 16, a flexible printed circuit (hereinafter F P C) 17, an elastic member 18 as a plate member, a pair of first switch portions 19, a pair of second switch portions 20, and a pair of knob supporting portions 26(FIG. 7).

The base member 16 is formed in a plate-like shape. The base member 16 lies under the F P C 17 which lies under the elastic member 18. A pair of fulcrum receiving pieces 21 are integrally formed in parallel on the base member 16 with a gap therebetween.

The fulcrum receiving pieces 21 project toward the fulcrum piece 12 of the operating tabular portion 13 of the knob 10 from the base member 16. The fulcrum receiving piece 21 each are formed in a plate in a longitudinal direction of a vehicle, namely in a longitudinal direction of the knob 10.

The fulcrum receiving piece 21 has each fulcrum receiving portion 22. The fulcrum receiving portion 22 is of a recess which is formed on the top of the fulcrum receiving piece 21. The fulcrum receiving portion 22 receives the fulcrum piece 12, and the knob 10 is capable of turning about an abutting point between the fulcrum piece 12 and the fulcrum receiving portion 22.

The FPC 17 is equipped with a bulb 23, the first contact portions 24 forming the first switch portions 19, and the second contact portions 25 forming the second switch portions 20.

The above bulb 23 is arranged under a central portion of the operating tabular portion 13 of the knob 10 and faces the pattern 13*c*.

The first contact portions 24 are provided under the respective first leg portions 14 formed on the respective end portions 13*a*,13*b* of the knob 10. The second contact portions 25 are provided under the respective second leg portions 15 formed on the respective end portions 13*a*, 13*b* of the knob 10.

And, a conductor pattern is formed on the FPC 17. The conductor pattern supplies electric power to light the bulb 23, and a window glass UP signal to raise the window glass and a window glass DOWN signals to lower the window glass are output from the contact portions 24,25 through the conductor pattern to the above non-shown ECU of the powerwindow unit. And, non-shown openings to receive the fulcrum receiving pieces 21 are formed on the FPC 17.

The elastic member 18 is made of elastic material such as rubber and is formed in a plate. The decorative member 7 is arranged on the elastic member 18.

Figure 6:
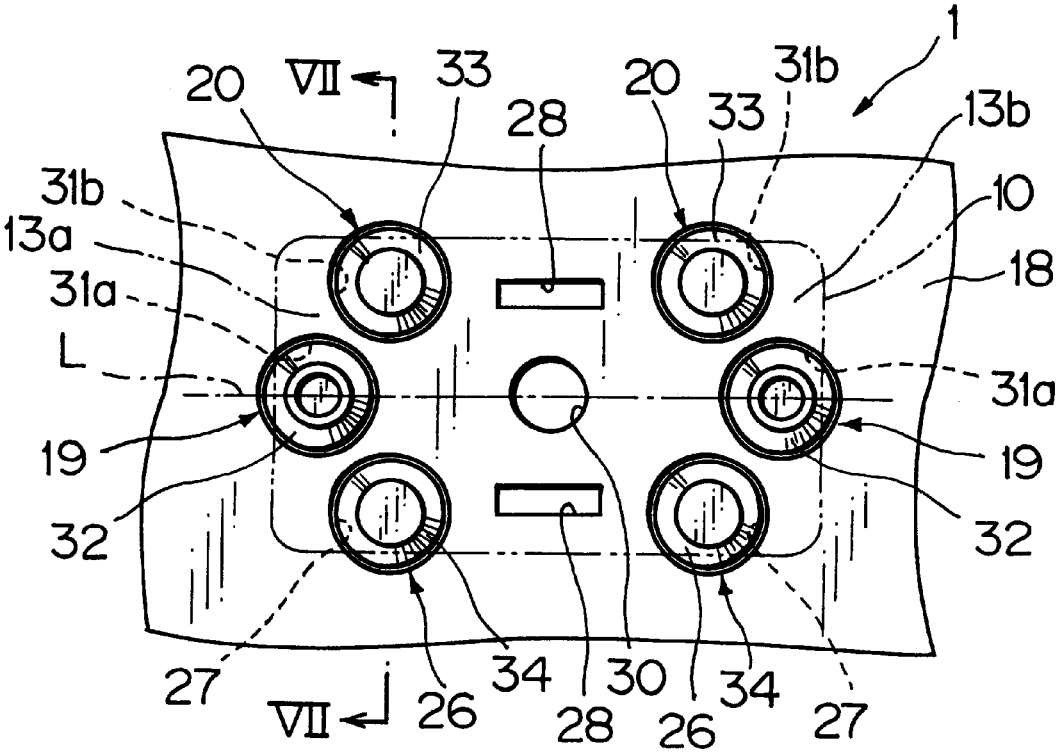
FIG. 6 is a plan view showing an arrangement of each element of the window switch.

As shown in FIGS. 3 and 6, the elastic member 18 is provided with a bulb exposing hole 30 to expose the bulb 23, contact portion exposing holes 31*a*,31*b* to expose the respective contact portions 24,25, through holes 27, and receiving piece penetration holes 28. The contact portion exposing holes 31*a*,31*b* are formed in the same shape.

The through holes 27 are positioned symmetrically with the contact portion exposing holes 31*b* with respect to a line L (FIG. 6) connecting the centers of the pair of first switch portions 19. The through holes 27 are formed generally in the same shape as the contact portion exposing holes 31*a*, 31*b*.

The receiving piece penetration holes 28 are formed in a shape capable of putting the fulcrum receiving piece 21 therethrough toward the knob 10.

And, the elastic member 18 (the plate member) integrally has a projections 32, second projections 33 and supporting projections 34. The projection 32 forms and outlines the first switch portion 19. The second projection 33 forms and outlines the second switch portion 20. The supporting projection 34 forms and outlines the knob supporting portion 26.

These projections 32,33,34 are formed of an elastic material such as rubber, similarly to the elastic member 18. The projections 32,33,34 are formed generally in the same shape. Specifically, the projections 32,33,34 are in a roughly conical shape.

The projections 32 extend from the respective peripheries of the contact portion exposing holes 31*a*. The second projections 33 extend from the respective peripheries of the contact portion exposing holes 31*b*. The supporting projections 34 extend from the respective peripheries of the through holes 27. And, the projections 32,33,34 have the respective end faces 36 which face the first and second leg portions 14,15. The end faces 36 of the projections 32 have respective recesses 37.

The above elastic member 18 outlines the FPC 17 in waterproof for protecting the conductor pattern thereof from a liquid such as water. The base member 16, the FPC 17, and the elastic member 18 are common for the switches 3,4,5,6 of the switch unit 1.

The first switch portions 19 face the respective first leg portions 14 positioned at one end portion 13*a* and the other end portion 13*b*, respectively.

The pair of first switch portions 19 are, as shown in FIG. 6, arranged on the longitudinal center line, i.e. aforementioned L (FIG. 6), of the knob 10. The knob 10 is positioned over the elastic member 18 as show with a dot-dash-line in FIG. 6.

The first switch portion 19 has the projection 32, the first contact portion 24 and the first contacting member 38. The first contact portion 24 and the first contacting member 38 are accommodated inside the projection 32. The first contacting member 38 is made of a rubber, or the like, having the electroconductivity. The first contacting member 38 faces the first contact portion 24.

Like the above, the first contacting member 38 is provided on both the end portions 13*a*,13*b* of the knob 10. And, when one end portion 13*a* of the knob 10 is pressed toward the base member 16, the projection 32 of one of the first switch portions 19 is pressed by one first leg portion 14 while being elastically deformed, whereby the first contacting member 38 comes into contact with the first contact portion 24, as shown in FIG. 4.

When the first contacting member 38 comes into contact with the first contact portion 24, this first contact portion 24 outputs the window glass UP signal to the ECU of the powerwindow unit. The window glass continues rising while the first contacting member 38 is in contact with the first contact portion 24.

On the other hand, when the other end portion 13*b* of the knob 10 is pressed toward the base member 16, the projection 32 of the other of the first switch portions 19 is pressed by the other first leg portion 14 while being elastically deformed, whereby the other first contacting member 38 comes into contact with the other first contact portion 24, as shown in FIG. 4.

Thus, the above first contact portion 24 outputs the window glass DOWN signal to the ECU of the powerwindow unit. The window glass continues lowering while the first contacting member 38 is in contact with the first contact portion 24.

The second switch portions 20 face the respective second leg portions 15 positioned at one end portion 13*a* and the other end portion 13*b*, respectively. The pair of second switch portions 20 are arranged apart from the line L and nearer a longitudinal middle portion of the knob 10 than the first switch portions 19. The second switch portions 20 are positioned under one side peripheral portion of the operating tabular portion 13 of the knob 10.

The second switch portion 20 has the second projection 33, the second contact portion 25 and the second contacting member 39. The second contact portion 25 and the second contacting member 39 are accommodated inside the second projection 33. The second contacting member 39 is made of a rubber, or the like, having the electroconductivity. The second contacting member 39 faces the second contact portion 25.

With the above structure, in a state that the first contacting member 38 and the first contact portion 24 are put into contact each other, when one end portion 13*a* of the knob 10 is further pushed toward the base member 16, the projection 32 is pressed by the first leg portion 14 and is elastically deformed, and simultaneously the second projection 33 is pressed by the second leg portion 15 and is elastically deformed.

Figure 5:
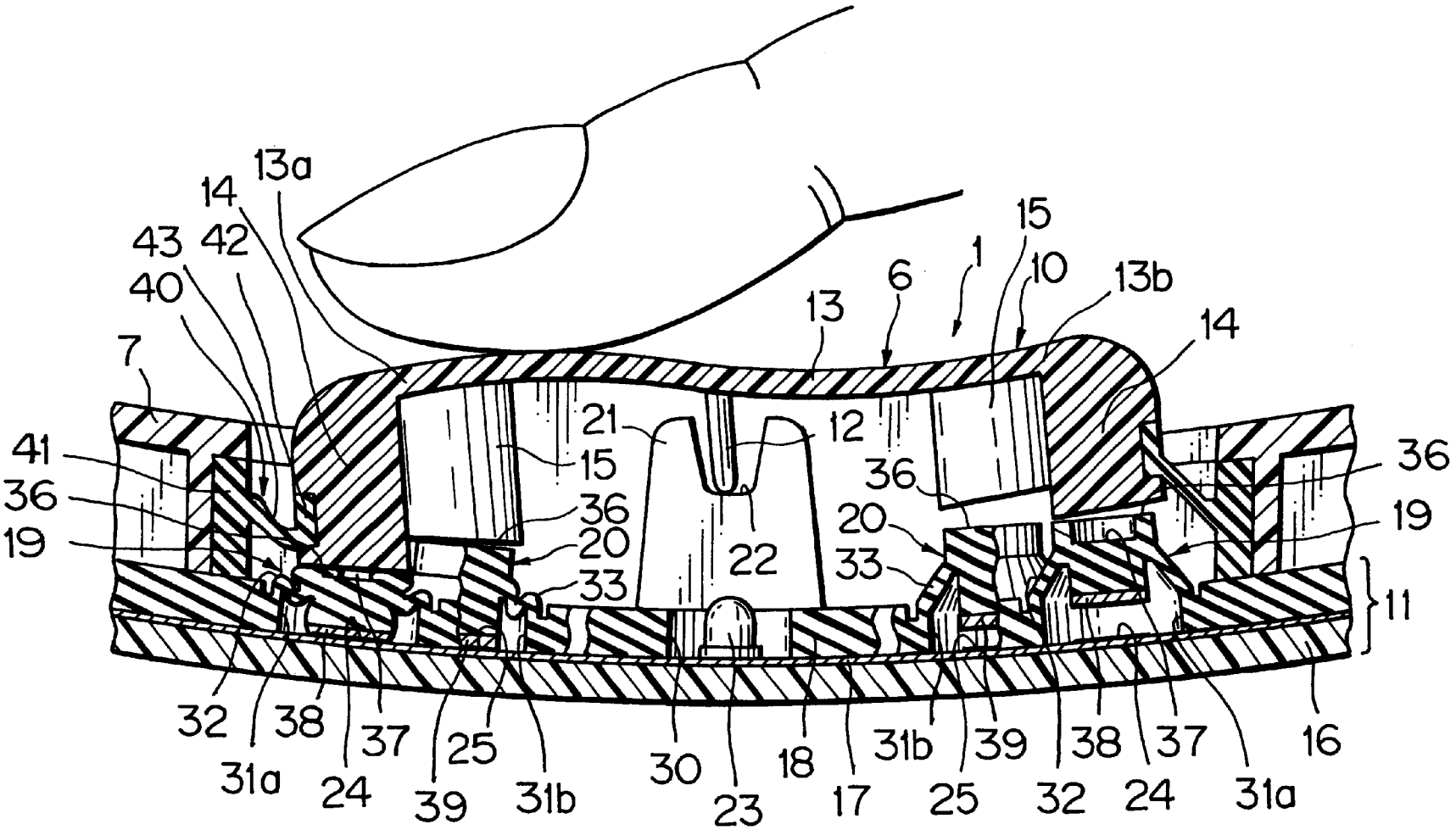
FIG. 5 is further a sectional view of the window switch of FIG. 4, wherein one end portion of the knob is further pushed.

And, as shown in FIG. 5, the second contacting member 39 and the second contact portion 25 of the second switch portion 20 positioned at the one end portion 13*a* of the knob 10 are put into contact each other.

Thus, the second contact portion 25 positioned at the one end portion 13*a* of the knob 10 outputs an UP signal (i.e. a second signal), which continuously raises the window glass up to the top position, to the ECU of the powerwindow unit. Then, the window glass rises up to the top position.

On the other hand, in a state that the first contacting member 38 and the first contact portion 24 of the other first switch portion 19 are put into contact each other, when the other end portion 13*b* of the knob 10 is further pushed toward the base member 16, the projection 32 is pressed by the first leg portion 14 and is elastically deformed, and simultaneously the second projection 33 is pressed by the second leg portion 15 and is elastically deformed.

And, the second contacting member 39 and the second contact portion 25 of the second switch portion 20 positioned at the other end portion 13*b* of the knob 10 are put into contact each other.

Thus, the second contact portion 25 positioned at the other end portion 13*b* of the knob 10 outputs a DOWN signal (i.e. a second signal), which continuously lowers the window glass to the bottom position, to the ECU of the powerwindow unit. Then, the window glass lowers to the bottom position.

The knob supporting portions 26 are arranged symmetrically with the second switch portions 20 with respect to the line L, while putting the first switch portions 19 therebetween. That is, the pair of knob supporting portions 26 are arranged apart from the line L and nearer the longitudinal middle portion of the knob 10 than the first switch portions 19. The knob supporting portions 26 are positioned under the other side peripheral portion of the operating tabular portion 13 of the knob 10.

The knob supporting portion 26 has the supporting projection 34 and a conductive rubber member 35 accommodated inside the supporting projection 34, as shown in FIG. 7. The conductive rubber member 35 is made of a rubber, or the like, having the electroconductivity and is formed in the same shape as the contacting members 38,39. The conductive rubber member 35 faces the above FPC 17.

According to the above structure, when one end portion 13*a* of the knob 10 is pressed as shown in FIG. 4 so that the first contacting member 38 comes into contact with the first contact portion 24, the knob supporting portion 26 as well as the second switch portion 20 abut against the second leg portion 15 of the knob 10. And, the knob supporting portion 26 supports the knob 10, similarly to the second switch portion 20. On the other hand, when the other end portion 13*b* of the knob 10 is pressed, the other one of the knob supporting portions 26 supports the knob 10, similarly to the other one of the second switch portions 20.

The elastic support member 40 is made of elastomer such as synthetic rubber or polyethylene resin. The elastic support member 40 is formed generally in a four-sided figure and surrounds the knob 10 along its periphery.

The elastic support member 40 surrounds a periphery of the knob 10 and makes a clearance between the knob 10 and the decorative member 7 and the knob 10 and another clearance between the knob 10 and the base 11 liquid-proof. That is, the elastic support member 40 protects the inside of the knob 10 from a liquid such as water.

And, the elastic support member 40 supports the knob 10 while keeping a gap between the fulcrum receiving portion 21 and the fulcrum piece 12.

The elastic support member 40 integrally consists of a base portion 41 arranged between the decorative member 7 and the elastic member 18 so as to make a clearance between them liquid-proof, a knob supporting portion 42 fitted on and over the periphery of the knob 10, and an elastically deforming portion 43 connecting the base portion 41 and the knob supporting portion 42.

The elastically deforming portion 43 keeps a relative position between the base portion 41 and the knob supporting portion 42 in a state that the fulcrum piece 12 and the fulcrum receiving portion 22 have the gap therebetween when the knob 10 is not pushed, namely in a non-operated time of the knob 10.

The elastically deforming portion 43 is elastically deformed when a pushing operation is made on one end portion 13*a* or on the other end portion 13*b* of the knob 10, whereby the fulcrum piece 12 and the fulcrum receiving portion 22 approaches each other and the first or second contact portion 24,25 comes into contact with the first or second contacting member 38,39, respectively.

The elastically deforming portion 43 returns the knob supporting portion 42, namely the knob, to the original position due to the elasticity thereof when the above pushing operation of the knob 10 ends.

According to the above switch unit 1, since the knob 10 is supported by the knob supporting portion 26 as well as the second switch portion 20 when the knob 10 is pushed, rolling of the knob 10 can prevented. Accordingly, the switch unit 1 enables the window glass to smoothly go up and down.

In the above-described switch unit, a pair of knob supporting portions may not be symmetrical with a pair of second switch portions.

And, the second switch portions may be replaced with the knob supporting portions.

Further, more than one pair of knob supporting portions may be arranged around each first switch portion 19 symmetrically or non-symmetrically with respect to the line L.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A switch unit, comprising:

an operative body being swingingly operably provided;

a pair of first switch portions being abuttable on respective end portions of the operative body when the operative body is swingingly operated so as to output signals to raise and lower, respectively, a window glass;

a pair of second switch portions arranged apart from a line connecting the pair of first switch portions and nearer a longitudinal middle portion of the operative body than the first switch portions and being abuttable on the operative body when the operative body is swingingly operated so as to output signals to raise and lower, respectively, the window glass; and a pair of supporting portions arranged opposite to the pair of second switch portions with respect to the line, wherein the supporting portions abut on respective portions of the operative body when the first switch portions abut on the respective end portions of the operative body.

2. The switch unit as set forth in claim 1, wherein the supporting portions are formed in a same shape as at least either of the first and second switch portions.

3. The switch unit as set forth in claim 2, further comprising a base equipped with the pair of first switch portions, the pair of second switch portions, and the pair of supporting portions, the base including a plate member having:

a pair of projections projecting toward the operative body and forming outlines of the respective first switch portions;

a pair of second projections being in a same shape as the projections, projecting toward the operative body, and forming outlines of the respective second switch portions; and a pair of supporting projections being in a same shape as the projections, projecting toward the operative body, and forming outlines of the respective supporting portions.

4. The switch unit as set forth in claim 3, wherein the pair of supporting portions are arranged symmetrically with the second switch portions with respect to the line.

5. The switch unit as set forth in claim 2, wherein the pair of supporting portions are arranged symmetrically with the second switch portions with respect to the line.

6. The switch unit as set forth in claim 1, wherein the pair of supporting portions are arranged symmetrically with the second switch portions with respect to the line.

7. A switch unit, comprising:

an operative body being swingingly operably provided;

a pair of first switch portions being abuttable on respective end portions of the operative body when the operative body is swingingly operated so as to output signals to raise and lower, respectively, a window glass; and a plurality of supporting portions arranged on both sides of a line connecting the pair of first switch portions and nearer a longitudinal middle portion of the operative body than the first switch portions while putting the first switch portions therebetween, wherein the supporting portions abut on respective portions of the operative body when the first switch portions abut on the respective end portions of the operative body.

8. The switch unit as set forth in claim 7, wherein the plurality of supporting portions are formed in a same shape as the first switch portions.

9. The switch unit as set forth in claim 8, further comprising a base equipped with the pair of first switch portions and the plurality of supporting portions, the base including a plate member having:

a pair of projections projecting toward the operative body and forming outlines of the respective first switch portions; and a plurality of supporting projections being in a same shape as the projections, projecting toward the operative body, and forming outlines of the respective supporting portions.

10. The switch unit as set forth in claim 9, wherein the plurality of supporting portions are arranged symmetrically with respect to the line.

11. The switch unit as set forth in claim 8, wherein the plurality of supporting portions are arranged symmetrically with respect to the line.

12. The switch unit as set forth in claim 7, wherein the plurality of supporting portions are arranged symmetrically with respect to the line.

* * * * *